United States Patent [19]

Johnson

[11] Patent Number: 4,605,030

[45] Date of Patent: Aug. 12, 1986

[54] PORTABLE ERECTILE VEHICLE SHELTER STRUCTURE

[76] Inventor: Jefrey K. Johnson, 250 Hampton Ct., Covina, Calif. 91723

[21] Appl. No.: 694,525

[22] Filed: Jan. 24, 1985

[51] Int. Cl.[4] ..... E04H 15/58; E04H 15/08; E04H 15/48; A47B 39/00

[52] U.S. Cl. ..... 135/117; 135/89; 135/113; 296/136

[58] Field of Search ..... 135/117, 88, 89; 296/136

[56] References Cited

U.S. PATENT DOCUMENTS

| | | | |
|---|---|---|---|
| 2,598,940 | 6/1952 | Robie | 135/88 |
| 2,755,811 | 7/1956 | Murray | 135/117 |
| 2,798,501 | 7/1957 | Oliver | 135/88 |
| 2,960,993 | 11/1960 | Holmstrom | 135/117 |
| 3,463,174 | 8/1969 | Heller | 135/109 |
| 3,465,765 | 9/1969 | Dietz | 135/117 |
| 4,066,089 | 1/1978 | Rainwater | 135/117 |
| 4,164,233 | 8/1979 | McAndrew | 296/136 |
| 4,184,501 | 1/1980 | Johnson | 135/88 |

FOREIGN PATENT DOCUMENTS

| | | | |
|---|---|---|---|
| 65748 | 2/1969 | German Democratic Rep. | 135/88 |
| 147957 | 4/1981 | German Democratic Rep. | 296/136 |
| 875992 | 8/1961 | United Kingdom | 135/88 |

*Primary Examiner*—Robert A. Hafer
*Assistant Examiner*—D. Neal Muir
*Attorney, Agent, or Firm*—Boniard I. Brown

[57] ABSTRACT

YA portable shelter primarily designed as a sunshade for automobiles which includes a pair of collapsible, hoop structures whose upper portions support a fabric shade and whose lower portions are hinged to pads on which the vehicle's tires are parked. A pair of collapsible compression members are locked between the sides of the hoops to maintain the hoops in shade providing positions.

16 Claims, 14 Drawing Figures

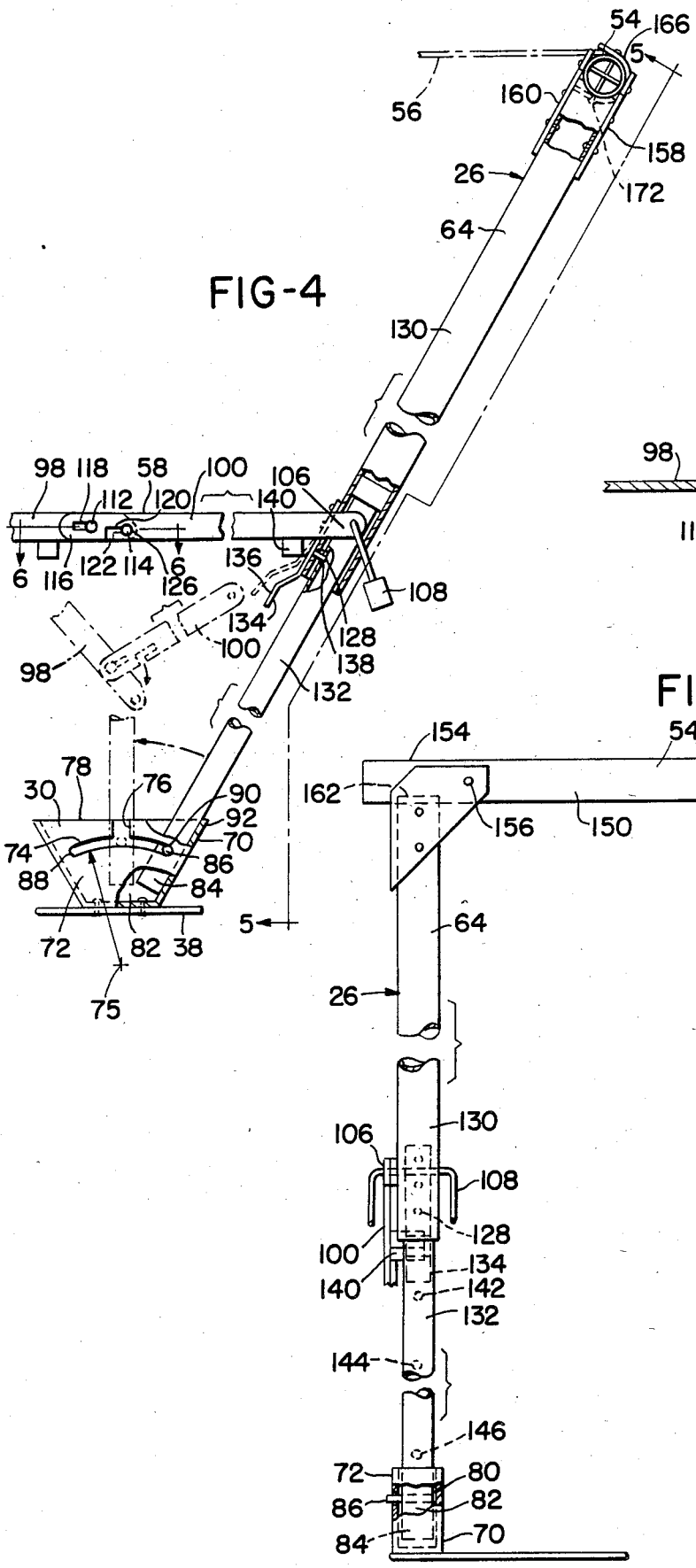
FIG-4
54
166
5
56
160
158
26
172
64
130
98
118
58
100
106
112
120
140
6
116
122
114
126
136
108
134
128
100
138
98
132
78
76
30
90
92
70
74
86
88
84
72
82
38
5
75
106
130
108
128
100
134
140
142
132
144
146
72
80
86
82
84
70
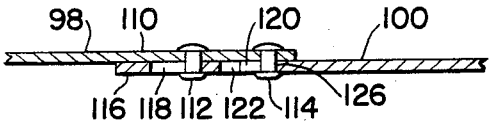
FIG-6
98
110
120
100
116
118
112
122
114
126
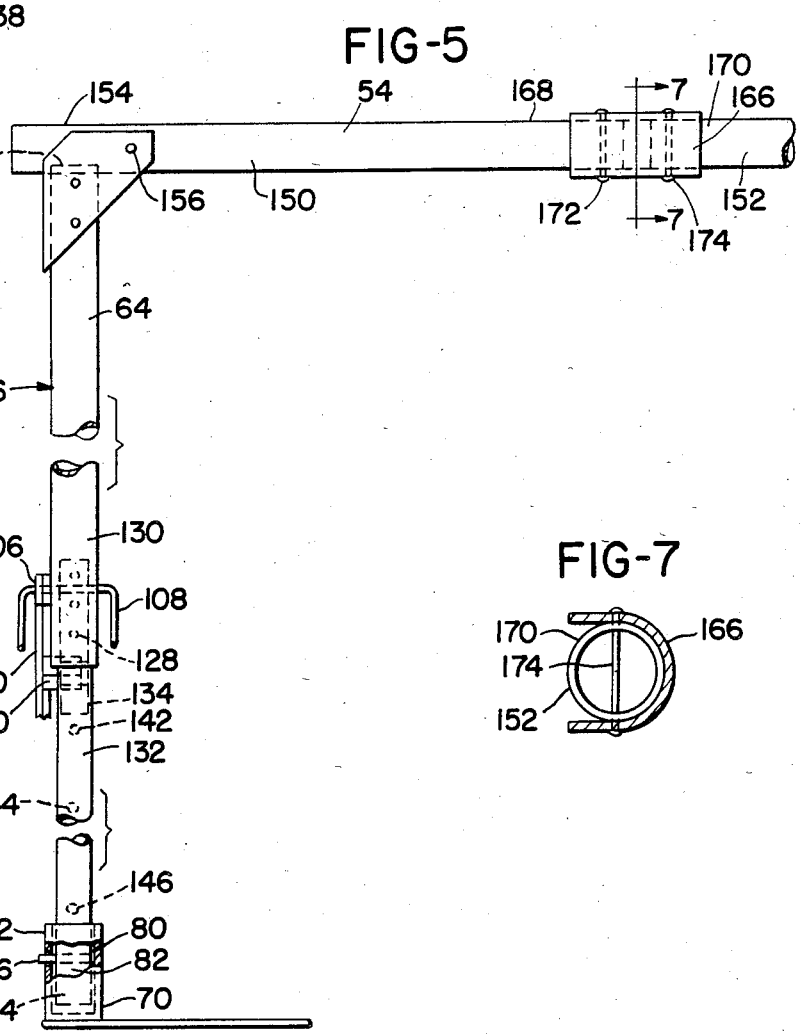
FIG-5
154
54
168
7
170
166
162
156
150
172
152
7
174
64
26
FIG-7
170
166
174
152

PORTABLE ERECTILE VEHICLE SHELTER STRUCTURE

BACKGROUND OF THE INVENTION

With the advent of metallic and highly lustrous but sun sensitive paints, interior plastics which degrade with temperature and exposure to ultraviolet light, and the gradual demise of inside parking, it has become desirable to provide sunshades for vehicles primarily in the form of car covers. Conventional car covers, although protecting vehicles from the elements, are supported by the surface thereof and especially during windy conditions, the covers rub against and gradually blemish the finish of the vehicles especially at their edges. Also, conventional car covers are easy to steal since they are merely fabric and rarely have effective theft prevention means.

In the past, semirigid collapsible structures have been known. Examples include the "Vehicle Supported Tent" disclosed by W. L. Ripley in U.S. Pat. No. 2,480,509; the "Foldable Canopy Frame" disclosed by E. Hervey in U.S. Pat. No. 2,571,362; the "Foldable Protector For Automobiles And The Like" disclosed by A. W. Harper in U.S. Pat. No. 2,858,837; the "Vehicle Shelter And Article Carrier" disclosed by W. R. Kilbride in U.S. Pat. No. 3,431,922; the "Automobile Mounted Shelter" disclosed by J. I. Lowery in U.S. Pat. No. 3,870,061; and the "Vehicle Covering Apparatus" disclosed by J. R. McAndrew in U.S. Pat. No. 4,164,233. Such devices have not met with great commercial success because they are either expensive and complex, are easily stolen, contact the surface of the vehicle and wear the finish thereof, must be permanently mounted to the vehicle, or cannot be carried and stored conveniently in the vehicle. Therefore, there has been need for a sunshade and shelter device for a vehicle which does not bear against the finish thereof, can collapse to a package easily carried in a minimal space within the vehicle and which is difficult to steal.

BRIEF DESCRIPTION OF THE PRESENT INVENTION

The present invention includes a pair of inverted U-shaped collapsible hoops whose upper cross members are used to support a canopy over a vehicle parked on pads from which the lower ends of the hoops are hinged. The hinges are releasable when not in canopy supporting position. A pair of collapsible compression linkages extend between the hoops when in the canopy supporting positions to maintain tension on the canopy between the two hoops and to prevent unhinging. The compression linkage is locked to the hoops so that vandals cannot collapse portions of the structure thereby causing damage to the vehicle nor can they steal the structure without substantial effort and heavy tools.

Since the structure rests on its pads, it may be erected whether a vehicle is present or not. Normally the pads are placed on the ground, and the collapsed hoops are hinged to the pads and pivoted away from each other to erect the canopy extending therebetween. The compression rods are then locked in place to maintain the positions of the hoops and the vehicle is driven onto the pads. By not placing the vehicle on the pads until the structure is erected allows the pads to be repositioned as the structure is erected if initially improperly spaced.

To store the structure, the compression rods are unlocked and partially collapsed, allowing the hoops to pivot inwardly until they can be released from the releasable hinges at the pads. The structure is folded and placed in the trunk of the vehicle. Thereafter, the vehicle is moved slightly and the four pads are also placed in the trunk. If theft of the structure is not a concern, the structure may be left erected and the vehicle driven under or out from under as desired.

It is therefore an object of the present invention to provide a collapsible sunshade and shelter for a vehicle which only contacts the tires of the vehicle.

Another object is to provide a collapsible sunshade for a vehicle which is lockable and requires no modification to the vehicle.

Another object is to provide an easily and economically constructible semirigid shelter for a vehicle which can be collapsed to a package, convenient for carrying within the vehicle.

Another object is to provide a vehicle sunshade which may be used in areas where the likelihood of theft to unsecured articles is high.

These and other objects of the present invention will become apparent to those skilled in the art after considering the following detailed specification together with the accompanying drawings wherein:

BRIEF DESCRIPTION OF THE DRAWINGS

FIG. 4 is an enlarged, partial cross-sectional, side view of a typical corner of the shelter;

FIG. 5 is an end elevational view taken at line 5—5 of FIG. 4;

FIG. 6 is an enlarged cross-sectional view taken at line 6—6 of FIG. 4;

FIG. 7 is an enlarged cross-sectional view taken at line 7—7 of FIG. 5;

DETAILED DESCRIPTION OF THE SHOWN EMBODIMENT

Figure 1:
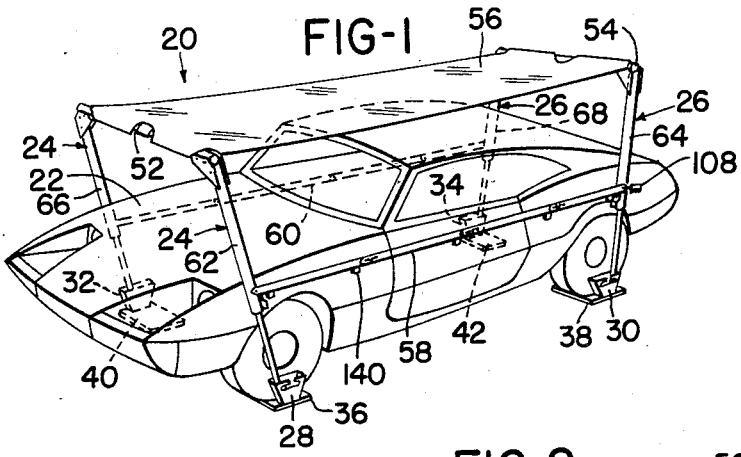
FIG. 1 is a perspective view of a shelter constructed according to the present invention in position sheltering an automobile.
Figure 2:
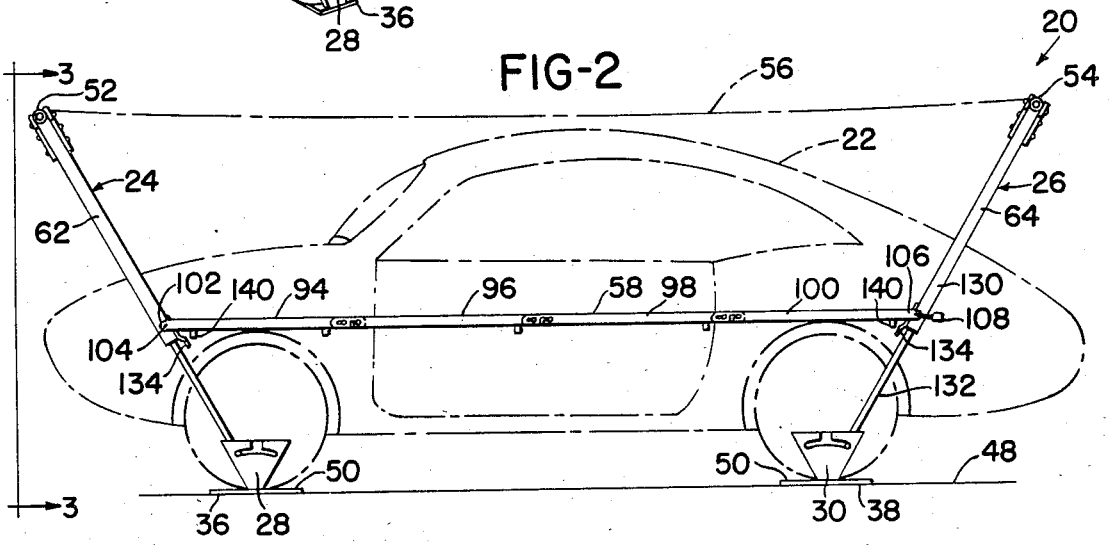
FIG. 2 is a side elevational view showing the shelter of FIG. 1 in its erected and locked position.
Figure 3:
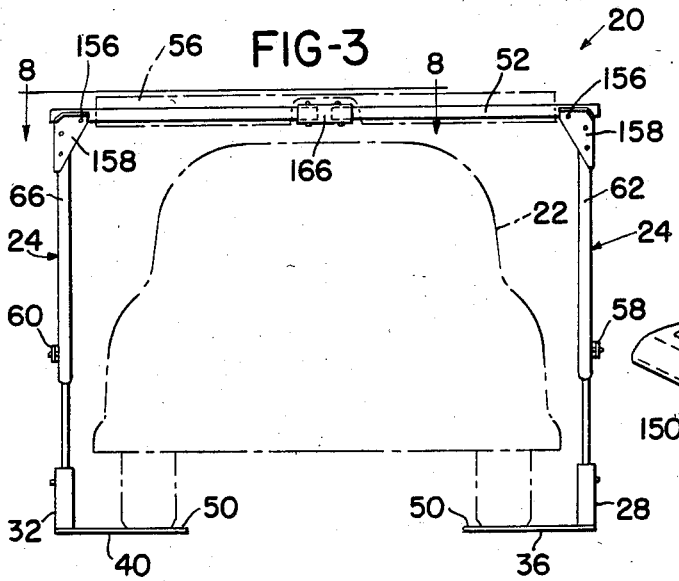
FIG. 3 is an end elevational view of the shelter of FIGS. 1 and 2 taken at line 3—3 of FIG. 2.

Referring to the drawings more particularly by reference numbers, number 20 in FIG. 1 refers to a vehicle shelter constructed according to the present invention shown in its erected position protecting a vehicle 22 from the elements. The shelter includes a pair of inverted U-shaped, collapsible hoops 24 and 26 which are pivoted by releasable hinges 28, 30, 32 and 34 connected to wheel pads 36, 38, 40 and 42 respectively on which the tires 44 of the vehicle 22 are positioned. The undersurfaces 46 of the pads 36, 38, 40 and 42 rest on the pavement 48 (FIG. 2) while the tires rest on the upper surfaces 50 thereof. This assures that so long as the vehicle 22 is parked and locked, the pads 36, 38, 40 and 42 (FIG. 3) will remain in their proper position resistant to high winds and the threat of thieves.

The hoops 24 and 26 include collapsible transverse cross members 52 and 54 respectively between which is strung a canopy 56. The canopy 56 provides shade and shelter for the vehicle 22. The canopy 56 is maintained in a taut position between the two cross members 52 and 54 by collapsible compression linkages 58 and 60 which extend between the hoops 24 and 26 from side portions 62 and 64 and 66 and 68 of the hoops 24 and 26 respectively.

Hinge 30 which is similar to hinges 28, 32, and 34 is shown in greater detail in FIG. 4. It includes a housing 70 having an outer side 72 through which is formed an arcuate cutout 74 having a center of curvature 75 below the pad 38 which with a vertical slot 76 extending therefrom provides a passageway through the upper surface 78 of the side 72. As can be seen, the arcuate cutout 74 extends to both sides of the slot 76. This is to allow the hinge 30 and the other hinges 28, 32, and 34 to be used universally in constructing the shelter 20. As can be seen with reference to FIG. 5, the outside 72 and the inside 80 of the housing 70 define an area 82 for receipt of the end 84 of the side portion 64 of the hoop 26. The end 84 includes a sidewardly extending pin 86 which can be inserted down through the slot 76 when the hoop 26 is in the vertical position and then rocked into either end 88 or 90 of the arcuate cutout 74. When used in the position shown in FIG. 4, the pin 86 extends into the hoop end 90 with the end 84 abutting a canted end surface 92 of the housing 70. When both hoops 24 and 26 are positioned with the ends of their side portions 62, 64, 66 and 68 outwardly, as shown in FIG. 4, with a canopy 56 drawn tight, the locking of the linkage 58 and 60 therebetween maintains such relative positioning.

Each linkage 58 and 60 includes a plurality of members 94, 96, 98 and 100. Each of the outer ends 102 of members 94 of linkages 58 and 60 is permanently hingedly connected to the side portion 62 or 66 of hoop 24 by pivots 104 while the outer ends 106 of members 100 are hingedly connected to the side portion 64 or 68 of hoop 26 by means of releasable locks 108.

The members 94, 96, 98 and 100 are connected as shown in FIGS. 4 and 6. Taking the connection between member 98 and 100 as an example, the outwardly extending end 110 of member 98 includes a pair of pins 112 and 114 which extend sidewardly therefrom. The inner end 116 of member 100 include a longitudinal slot 118 through which pin 112 provides a hinged connection whose hinge point can be moved along the slot 118, and a L-shaped slot 120 having an end 122 which extends through the side 124 of the member 100 into which the pin 114 can be inserted. Once inserted, the pin 114 is slid to the opposite end 126 of the slot 120 which motion is allowed by the slot 118. So long as the linkage 58 remains in compression, the pins 112 and 114 cannot be slid in the opposite direction to allow relative rotation between the members 98 and 100, as shown in dashed outline in FIG. 4. Since this compression is maintained by the canopy 56, the lock 108 and the hinge 30, the shelter 20 remains erected when a vehicle 22 is parked thereon no matter what the weather conditions.

The side portions 62, 64, 66 and 68 telescope to a collapsible positions. They are maintained in the extended position shown for side portion 64 in FIG. 4 by means of a lock pin 128 which extends between the outer tube 130 and inner tube 132 of the side portion 62. The lock pin 28 is connected to a spring release arm 134 which has a handle 136 for lifting the pin 128 out of its locking orifice 138 in the inner tube 132. Since release of the lock pin 128 would defeat the rigidity of the shelter 20, adjacent blocks 140 are provided on the linkages 58 and 60 in position to interfere with movement of the spring release arms 134 to the position shown in dashed outline in FIG. 4 when the linkages 58 and 60 are in the locked positions shown. Similar blocks 140 and release arms 134 are provided on each side portion 62, 64, 66 and 68. As shown in FIG. 5, the inner tube 132 includes other orifices 142, 144 to provide adjustment for vehicles of differing wheel bases and an orifice 146 for holding the inner and the outer tubes 132 and 130 in a totally collapsed position for storage.

Figure 8:
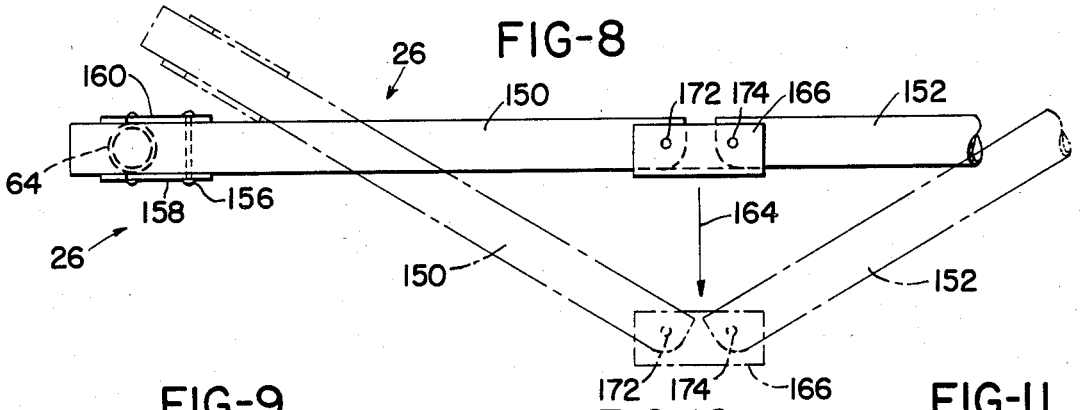
FIG. 8 is an enlarged view taken at line 8—8 of FIG. 3 showing the folding action of transverse tubes of the hoops.
Figure 9:
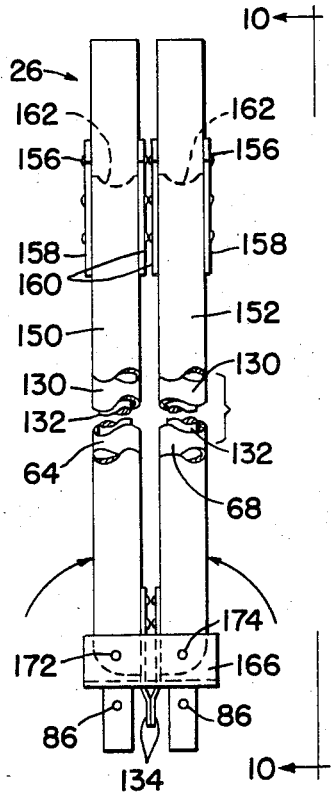
FIG. 9 is a broken detailed view of the hoop tubes of the shelter folded for storage.
Figure 10:
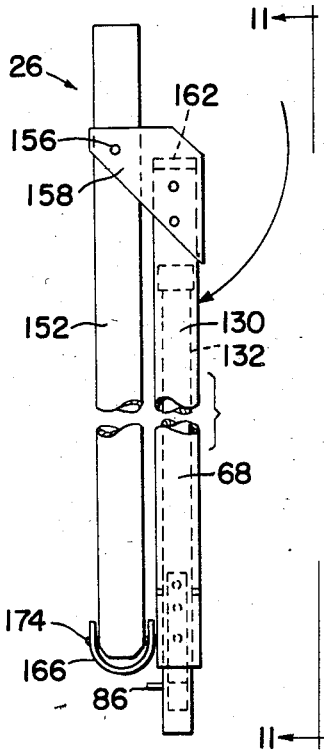
FIG. 10 is a side view taken at line 10—10 of FIG. 9.
Figure 11:
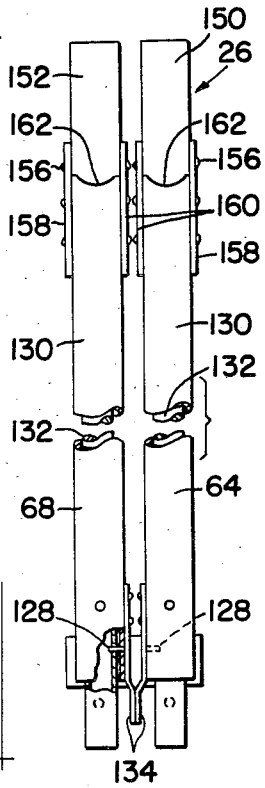
FIG. 11 is a bottom view taken at line 11—11 of FIG. 10.
Figure 12:
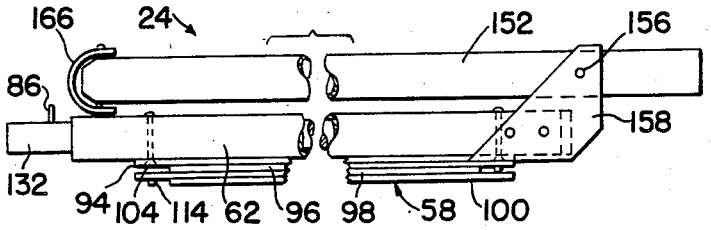
FIG. 12 is a side elevational view of the left hand end tubes forming the hoops with their linkages folded for storage.
Figure 13:
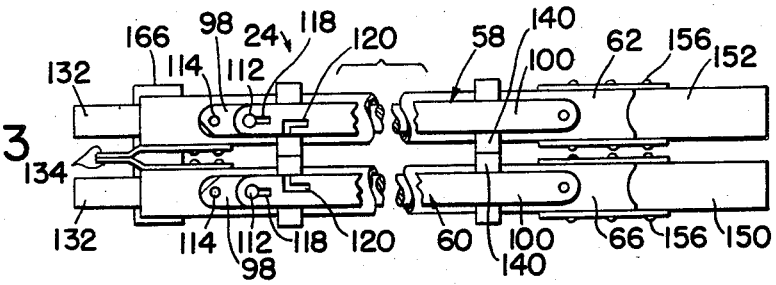
FIG. 13 is a bottom view of the left end tubes with their linkages folded for storage.

The cross members 52 and 54 of the hoops 24 and 26 each includes a pair of tubular members 150 and 152. The outer ends 154 of both members 150 and 152 are pivoted by means of a hinge pin 156 positioned inside its respective side portion which extends between a pair of hinge support members 158 and 160. The ends 162 of the outer tubes 130 abut the ends 154 of the members 150 to restrict pivoting movement more than the 90° angle shown in FIG. 5, while allowing the members 150 to swing downwardly in the direction of the arrow 164. The members 150 and 152 are also hingedly connected together by elongated U-shaped coupler members 166 which are connected to the inner facing ends 168 and 170 of the members 150 and 152 by pivot pins 172 and 174 respectively. As shown in FIG. 8, when the hoops 24 and 26 are disconnected from the hinges 28, 30, 32 and 34, the hinge coupler members 166 allow the members 150 and 152 to fold from their linear relationship only in the direction shown to parallel relationships. This allows the side portions 62 and 66 of hoop 24 and side portions 64 and 68 of hoop 26 to be brought together as shown in FIGS. 9, 10, 11 and 12 wherein the inner and outer rods 132 and 130 have been telescoped within each other. Thereafter, the members 150 and 152 can be folded down against the side portions 62, 64, 66 and 68 as shown in FIG. 10, so that each of the hoops 24 and 26 can be collapsed into a convenient package. As shown in FIGS. 12 and 13, the compression linkages 58 and 60 which remain connected to the hoop 24 are folded back and forth to provide storage therefor.

Figure 14:
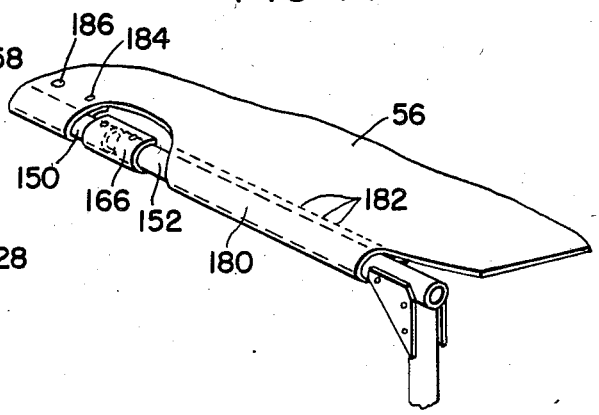
FIG. 14 is an illustrative detail view showing various ways the sunshading canopy fabric may be connected to the transverse tubes of the hoops.

Details of how the canopy can be connected to the members 150 and 152 are shown in the alternative in FIG. 14 where the end 180 of the canopy is wrapped 360° therearound and then secured by stitches 182, rivets 184, or snaps 186. To allow ease of folding, snaps 186 are preferred. However, the stitching 182 and the rivets 184 provide a more secure attachment method when thieves are expected.

Thus there has been shown and described a novel portable shelter which fulfills all the objects and advantages sought therefor. Many changes, modifications, variations and other uses and applications of the subject invention will, however, become apparent to those skilled in the art after considering this Specification and the accompanying drawings. All such changes, modifications, alterations and other uses and applications which do not depart from the spirit and scope of the invention are deemed to be covered by the invention which is limited only by the claims which follow.

What is claimed is:

1. A collapsible structure for sheltering a vehicle having at least four wheels including:

a first pad member having:

a first pad adapted for placement on the ground with a first wheel of the vehicle to be sheltered parked thereon; and first hinge means housing connected to said pad; a second pad member having:

a second pad adapted for placement on the ground with a second wheel of the vehicle to be sheltered parked thereon; and second hinge means housing connected to said pad;

a third pad member having:

a third pad adapted for placement on the ground with a third wheel of the vehicle to be sheltered parked thereon; and third hinge means housing connected to said pad; a fourth pad member having:

a fourth pad adapted for placement on the ground with a fourth wheel of the vehicle to be sheltered parked thereon; and fourth hinge means housing connected to said pad; a first collapsible hoop having:

a first side with a first end pivoting in said first hinge means housing;

a second side with a second end pivoting in said second hinge means housing; and a center portion connecting said first and second sides thereof;

a second collapsible hoop having:

a first side with a third end pivoting in said third hinge means housing;

a second side with a fourth end pivoting in said fourth hinge means housing; and a center portion connecting said first and second sides thereof;

first collapsible linkage connected to said first side portions of said first and second collapsible hoops;

second collapsible linkage connected to said second side portions of said first and second collapsible hoops; and a canopy connected between said center portions of said first and second collapsible hoops, said first end including:

a sidewardly facing pin extending therefrom, and said first hinge means housing includes:

first and second side plates spaced for insertion of said first hoop end therebetween, said first side plate including:

a generally horizontal cutout therein;

an upper surface; and a generally vertical slot through said upper surface to said generally horizontal cutout whereby said sidewardly facing pin can be slid through said generally vertical slot and positioned in said generally horizontal cutout for pivoting therein.

2. The collapsible structure as defined in claim 1 wherein said generally horizontal cutout includes:

first and second opposite ends; and a central portion connecting said first and second opposite ends, said generally horizontal cutout being an arcuate cutout having a center of curvature which is positioned below said first pad.

3. The collapsible structure as defined in claim 2 wherein said first hinge means housing further includes:

a first end abutment plate extending between said first and second side plates perpendicular thereto adjacent said first end of said arcuate cutout and located at an angle which generally extends toward said center of curvature of said arcuate cutout; and a second end abutment plate extending between said first and second side plates perpendicular thereto adjacent said second end of said arcuate cutout and located at an angle which generally extends toward said center of curvature of said arcuate cutout, whereby said first end of said first collapsible hoop abuts said first end abutment plate when erected in said first hinge means housing.

4. The collapsible structure as defined in claim 3 wherein said first side of said first collapsible hoop includes:

an outer tube having:

an outer tube orifice defined therethrough; and a release arm connected thereto with:

a lock pin mounted to said release arm and biased thereby to extend through said outer tube orifice; and an inner tube which telescopes within said outer tube, said outer tube having:

a plurality of inner tube orifices defined therethrough in positions which allow said lock pin to extend therethrough to fix relative telescoping positions of said inner and outer tubes.

5. The collapsible structure as defined in claim 4 wherein said first collapsible linkage includes:

a first blocking member positioned to restrict movement of said release arm and thereby prevent said lock pin mounted thereto from being withdrawn from one of said inner tube orifices.

6. The collapsible structure as defined in claim 5 wherein said first side of said second collapsible hoop includes:

an outer tube having:

an outer tube orifice defined therethrough; and a release arm connected thereto with:

a lock pin mounted to said release arm and biased thereby to extend through said outer tube orifice; and an inner tube which telescopes within said outer tube, said outer tube having:

a plurality of inner tube orifices defined therethrough in positions which allow said lock pin to extend therethrough to fix relative telescoping positions of said inner and outer tubes, and wherein said first collapsible linkage includes:

a second blocking member positioned to restrict movement of said release arm of said second collapsible hoop and thereby prevent said lock pin mounted thereto from being withdrawn from one of said inner tube orifices.

7. The collapsible structure as defined in claim 6 wherein said first collapsible linkage includes:

at least first and second link members, said first link member being connected to said second link member hinge means whose pivoting is restricted by compression force applied between said first and second link members.

8. The collapsible structure as defined in claim 6 wherein said first collapsible linkage includes:

at least first and second link members, said first link member having:

a flat side portion;
a pivot member extending sidewardly from said flat side portion; and
a link pin extending sidewardly from said flat side portion spaced from said pivot member, said second link member having:
a flat side portion;
a longitudinal slot defined through said flat side portion in which said pivot member is retained; and
a L shaped slot defined through said flat side portion spaced from said longitudinal slot with the bottom of the L toward said longitudinal slot in and out of which said link pin can slide, whereby compression forces between said first and second link members maintain said link pin in said L shaped slot and thus maintain said first and second link members in a non-pivoting condition.

9. The collapsible structure as defined in claim 8 wherein said first collapsible hoop center portion includes:
a first member pivotally connected to said first side of said first collapsible hoop on a first axis;
a second member pivotally connected to said second side of said first collapsible hoop on a second axis parallel to said first axis; and
a center member pivotally connected to said first member on a third axis generally perpendicular to said first and second axes and pivotally connected to said second member on a fourth axis generally perpendicular to said first and second axes and parallel to said third axis.

10. A collapsible structure for sheltering a vehicle having at least four wheels including:
a first pad member having:
a first pad adapted for placement on the ground with a first wheel of the vehicle to be sheltered parked thereon; and
first hinge means housing connected to said pad; a second pad member having:
a second pad adapted for placement on the ground with a second wheel of the vehicle to be sheltered parked thereon; and
second hinge means housing connected to said pad; a third pad member having:
a third pad adapted for placement on the ground with a third wheel of the vehicle to be sheltered parked thereon; and
third hinge means housing connected to said pad;
a fourth pad member having:
a fourth pad adapted for placement on the ground with a fourth wheel of the vehicle to be sheltered parked thereon; and
fourth hinge means housing connected to said pad; a first collapsible hoop having:
a first side with a first end pivoting in said first hinge means housing;
a second side with a second end pivoting in said second hinge means housing; and
a center portion connecting said first and second sides thereof;
a second collapsible hoop having:
a first side with a third end pivoting in said third hinge means housing;
a second side with a fourth end pivoting in said fourth hinge means housing; and
a center portion connecting said first and second sides thereof;
first collapsible linkage connected to said first side portions of said first and second collapsible hoops;
second collapsible linkage connected to said second side portions of said first and second collapsible hoops; and
a canopy connected between said center portions of said first and second collapsible hoops, said first side of said second collapsible hoop including:
an outer tube having:
an outer tube orifice defined therethrough; and
a release arm connected thereto with:
a lock pin mounted to said release arm and biased thereby to extend through said outer tube orifice; and
an inner tube which telescopes within said outer tube, said outer tube having:
a plurality of inner tube orifices defined therethrough in positions which allow said lock pin to extend therethrough to fix relative telescoping positions of said inner and outer tubes, and wherein said first collapsible linkage includes:
a second blocking member positioned to restrict movement of said release arm of said second collapsible hoop and thereby prevent said lock pin mounted thereto from being withdrawn from one of said inner tube orifices.

11. The collapsible structure as defined in claim 10 wherein said first collapsible linkage includes:
at least first and second link members, said first link member being connected to said second link member hinge means whose pivoting is restricted by compression force applied between said first and second link members.

12. The collapsible structure as defined in claim 10 wherein said first collapsible linkage includes:
at least first and second link members, said first link member having:
a flat side portion;
a pivot member extending sidewardly from said flat side portion; and
a link pin extending sidewardly from said flat side portion spaced from said pivot member, said second link member having:
a flat side portion;
a longitudinal slot defined through said flat side portion in which said pivot member is retained; and
a L shaped slot defined through said flat side portion spaced from said longitudinal slot with the bottom of the L toward said longitudinal slot in and out of which said link pin can slide, whereby compression forces between said first and second link members maintain said link pin in said L shaped slot and thus maintain said first and second link members in a non-pivoting condition.

13. A structure for sheltering a vehicle having wheels including:
a first pad member having:
a first pad adapted for placement on the ground with a wheel of the vehicle to be sheltered parked thereon; and
first hinge means housing connected to said pad;
a second pad member having:
a second pad adapted for placement on the ground with a wheel of the vehicle to be sheltered parked thereon; and
second hinge means housing connected to said pad;
a third pad member having:

a third pad adapted for placement on the ground with a wheel of the vehicle to be sheltered parked thereon; and third hinge means housing connected to said pad;

a fourth pad member having:

a fourth pad adapted for placement on the ground with a wheel of the vehicle to be sheltered parked thereon; and fourth hinge means housing connected to said pad;

a first hoop having:

a first side with a first end pivoting in said first hinge means housing;

a second side with a second end pivoting in said second hinge means housing; and a center portion connecting said first and second sides thereof;

a second hoop having:

a first side with a third end pivoting in said third hinge means housing;

a second side with a fourth end pivoting in said fourth hinge means housing; and a center portion connecting said first and second sides thereof;

first linkage connected to said first side portions of said first and second hoops; and a shape connected between said center portions of said first and second hoops, said first end including:

a sidewardly facing pin extending therefrom, and said first hinge means housing including:

first and second side plates spaced for insertion of said first hoop end therebetween, said first side plate including:

a generally horizontal cutout therein, said generally horizontal cutout including:

first and second opposite ends; and a central portion connecting said first and second opposite ends;

an upper surface; and a generally vertical slot through said upper surface to said central portion of said generally horizontal cutout whereby said sidewardly facing pin can be slid through said generally vertical slot and positioned in an opposite end of said generally horizontal cutout for pivoting therein.

14. The structure as defined in claim 13 wherein said first side of said first hoop includes:

an outer tube having:

an outer tube orifice defined therethrough; and a release arm connected thereto with:

a lock pin mounted to said release arm and biased thereby to extend through said outer tube orifice; and an inner tube which telescopes within said outer tube, said outer tube having:

a plurality of inner tube orifices defined therethrough in positions which allow said lock pin to extend therethrough to fix relative telescoping positions of said inner and outer tubes, and wherein said first linkage includes:

a first blocking member positioned to restrict movement of said release arm and thereby prevent said lock pin mounted thereto from being withdrawn from one of said inner tube orifices.

15. The structure as defined in claim 14 wherein said first hoop center portion includes:

a first center portion member pivotally connected to said first side of said first hoop on a first axis;

a second center portion member pivotally connected to said second side of said first hoop on a second axis parallel to said first axis; and a central center portion member pivotally connected to said first center portion member on a third axis generally perpendicular to said first and second axes and pivotally connected to said second center portion member on a fourth axis generally perpendicular to said first and second axes and parallel to said third axis.

16. A collapsible structure for sheltering a vehicle having at least four wheels including:

a first pad member having:

a first pad adapted for placement on the ground with a first wheel of the vehicle to be sheltered parked thereon; and first hinge means housing connected to said pad;

a second pad member having:

a second pad adapted for placement on the ground with a second wheel of the vehicle to be sheltered parked thereon; and second hinge means housing connected to said pad;

a third pad member having:

a third pad adapted for placement on the ground with a third wheel of the vehicle to be sheltered parked thereon; and third hinge means housing connected to said pad;

a fourth pad member having:

a fourth pad adapted for placement on the ground with a fourth wheel of the vehicle to be sheltered parked thereon; and fourth hinge means housing connected to said pad;

a first collapsible hoop having:

a first side with a first end pivoting in said first hinge means housing;

a second side with a second end pivoting in said second hinge means housing; and a center portion connecting said first and second sides thereof;

a second collapsible hoop having:

a first side with a third end pivoting in said third hinge means housing;

a second side with a fourth end pivoting in said fourth hinge means housing; and a center portion connecting said first and second sides thereof;

first collapsible linkage connected to said first side portions of said first and second collapsible hoops;

second collapsible linkage connected to said second side portions of said first and second collapsible hoops; and a canopy connected between said center portions of said first and second collapsible hoops, said first side of said first collapsible hoop including:

an outer tube having:

an outer tube orifice defined therethrough; and a release arm connected thereto with:

a lock pin mounted to said release arm and biased thereby to extend through said outer tube orifice; and an inner tube which telescopes within said outer tube, said inner tube having:

a plurality of inner tube orifices defined therethrough in positions which allow said lock pin to extend therethrough to fix relative telescoping positions of said inner and outer tubes, said first collapsible linkage including:

a first blocking member positioned to restrict movement of said release arm and thereby prevent said lock pin mounted thereto from being withdrawn from one of said inner tube orifices.

* * * * *